United States Patent [19]

Kaufman et al.

[11] Patent Number: 4,998,887

[45] Date of Patent: Mar. 12, 1991

[54] PIN HEADER CONNECTOR

[75] Inventors: John W. Kaufman, Hershey; Donald J. Summers, Shiremanstown, both of Pa.

[73] Assignee: AMP Incorporated, Harrisburg, Pa.

[21] Appl. No.: 543,235

[22] Filed: Jun. 25, 1990

[51] Int. Cl.[5] ..... H01R 9/09

[52] U.S. Cl. ..... 439/78; 439/81; 439/83; 439/248; 439/598; 439/701

[58] Field of Search ..... 439/78, 81, 83, 247, 439/248, 598, 701, 712

[56] References Cited

U.S. PATENT DOCUMENTS

| | | | |
|---|---|---|---|
| 3,397,784 | 8/1968 | Laurence | 439/246 |
| 4,391,482 | 7/1983 | Czeschka | 439/78 |
| 4,678,250 | 7/1987 | Romine et al. | 439/83 |
| 4,682,829 | 6/1985 | Kunkle et al. | 439/83 |
| 4,690,595 | 10/1987 | Nakazawa et al. | 439/701 |
| 4,709,976 | 12/1987 | Nakama et al. | 439/701 |
| 4,780,090 | 10/1988 | Sugiyama et al. | 439/247 |
| 4,828,503 | 10/1988 | Gilissen et al. | 439/62 |
| 4,854,882 | 8/1989 | Corridori | 439/248 |
| 4,867,690 | 9/1989 | Thumma | 439/79 |
| 4,871,320 | 10/1989 | Mouissie | 439/78 |
| 4,895,521 | 1/1990 | Grabbe | 439/63 |
| 4,898,539 | 2/1990 | Glover et al. | 439/81 |

FOREIGN PATENT DOCUMENTS

| | | | |
|---|---|---|---|
| 2045547 | 10/1980 | United Kingdom | 439/246 |

*Primary Examiner*—Paula A. Bradley

*Attorney, Agent, or Firm*—Katherine A. Nelson

[57] ABSTRACT

An improved pin header connector (10) mountable to a circuit substrate (120) includes a plurality of modular terminal subassemblies (12), shell means (59) defining a like plurality of terminal subassembly receiving cavities (108) and including means securing the terminal subassemblies (12) within respective cavities (108) in a manner permitting incremental floating of the subassemblies (12) in a transverse direction relative to the shell means (59), and means (50) included on each terminal subassembly (12) for aligning the terminal members (16) thereof with corresponding circuit pads (122) on the circuit substrate (120) upon the connector (10) being mounted to the substrate (120). Each subassembly (12) includes an array of terminal members (16) secured in dielectric means (40), each terminal member (16) having a rearward connecting portion (20) at least exposed at a mounting surface of the dielectric substrate (40), the second connecting portions (20) of the terminal members (16) being adapted to electrically engage respective conductive areas (122) of a corresponding array on a circuit substrate (120). The connector (10) further includes means independent of the aligning means for mounting the shell means (59) to the substrate (120).

8 Claims, 4 Drawing Sheets

PIN HEADER CONNECTOR

FIELD OF THE INVENTION

The present invention relates to a pin header connector for a two piece connector system, the pin header being surface mountable to a circuit board, back panel or the like.

BACKGROUND OF THE INVENTION

Pin header connectors for two piece connector systems having contact elements with posts for insertion into plated holes in a circuit board such as a back panel are well known in the art. U.S. Pat. No. 4,867,690 discloses one such connector in which the pins are staked into a molded housing with pins extending into an outwardly open cavity and posts extending outwardly from a base surface for insertion into plated through holes of the circuit board. Since this type of header requires the plurality of plated through holes in the circuit board, it is particularly suitable for multi-layer circuit boards. In many instances, however, it is more advantageous to use surface mounted contact terminals to minimize the number of holes in the circuit board particularly in single layer boards. U.S. patent Ser. No. 07/452,523, filed Dec. 18, 1989, and owned by the assignee of the present invention, discloses a pin header having a plurality of contact terminals having contact portions designed to interconnect with circuitry on the surface of a panel. The pin header includes a housing having a plurality of terminal members, each having a C-shaped spring arm with outwardly facing contact surfaces for electrically engaging the circuits of a panel.

The pin header as disclosed in Ser. No. 07/452,523 includes a plurality of inserts disposed in a metal shell, each of the inserts including an array of contact terminals disposed in a dielectric housing, the insert being sized to be frictionally received within corresponding cavities of the shell member. The number of inserts included in a particular connector depends upon the number of interconnections desired between the connector and the panel. In today's electronic industry there is increasing need for higher density connectors, having larger pin counts as well as more closely spaced arrays of terminal members. The higher density connectors are particularly suitable for surface mounting, since this eliminates the need for holes through the circuit board and the space considerations associated therewith. Concomitantly, the size of the circuit pads on the circuit board or panel must be minimized in order to space them more closely together. It is necessary, therefore, to control the manufacturing and assembly processes to prevent misalignment of corresponding terminals and pads owing to an accumulation of tolerance variations. Furthermore, as the number of contact terminals is increased in the connector, the number of inserts may also be increased and the tolerances associated with the addition of further terminal carrying inserts can accumulate such that the surface mounted contact sections of the terminals do not engage the corresponding circuit paths at all locations along the entire length of the connector.

It is desirable therefore, to provide a connector with a plurality of "floatable" modular inserts, each insert having means to align the corresponding terminal contact portions with the circuit pads of the circuit board independently of any other inserts in the connector and independently of the means for mounting the connector to the circuit substrate.

SUMMARY OF THE INVENTION

Accordingly, the present invention is directed to an improved pin header connector surface mountable to a circuit substrate that overcomes the deficiencies and disadvantages of the prior art. The pin header for the present invention is comprised of a plurality of modular terminal subassemblies, shell means defining a like plurality of terminal subassembly receiving cavities and including means securing the terminal subassemblies within respective cavities in a manner permitting incremental floating of the subassemblies in a transverse direction relative to the shell means. Each terminal subassembly comprises an array of terminal members secured in a dielectric means, each terminal member having a forward connecting portion engageable with a complementary mating connector and a second connecting portion adapted to electrically engage respective conducting areas of a corresponding array on a circuit substrate. Each terminal subassembly further includes aligning means cooperable with corresponding aligning means of the circuit substrate associated with each array of conductive areas of the substrate. When the connector is mounted to the substrate the aligning means of each terminal subassembly independently cooperates with the corresponding circuit substrate aligning means to align the contact portions of the terminal members with the respective conductive portions on the substrate. The connector also includes means independent of the aligning means for mounting the shell members to the substrate. In the preferred embodiment the shell means includes forward and rearward shell members which when secured together define the plurality of terminal subassembly cavities.

It is an object of the present invention to provide a pin header connector that is surface mountable to a circuit board.

It is also an object of the invention to provide a high density surface mountable pin header connector.

It is another object of the invention to have a connector with means for aligning modular terminal subassemblies independently of one another within sections of a continuous shell member.

It is another object of the invention to provide a pin header assembly wherein a terminal subassembly can be easily replaced, thereby facilitating repair of the connector should damage occur.

It is an additional object of the invention to provide a pin header assembly that minimizes the accumulation of tolerances associated with connectors including a large number of terminal members.

The invention itself, together with further objects and attendant advantages of the invention will be best understood by reference to the following detailed description, taken in conjunction with the accompanying drawing.

DESCRIPTION OF THE INVENTION

Figure 1:
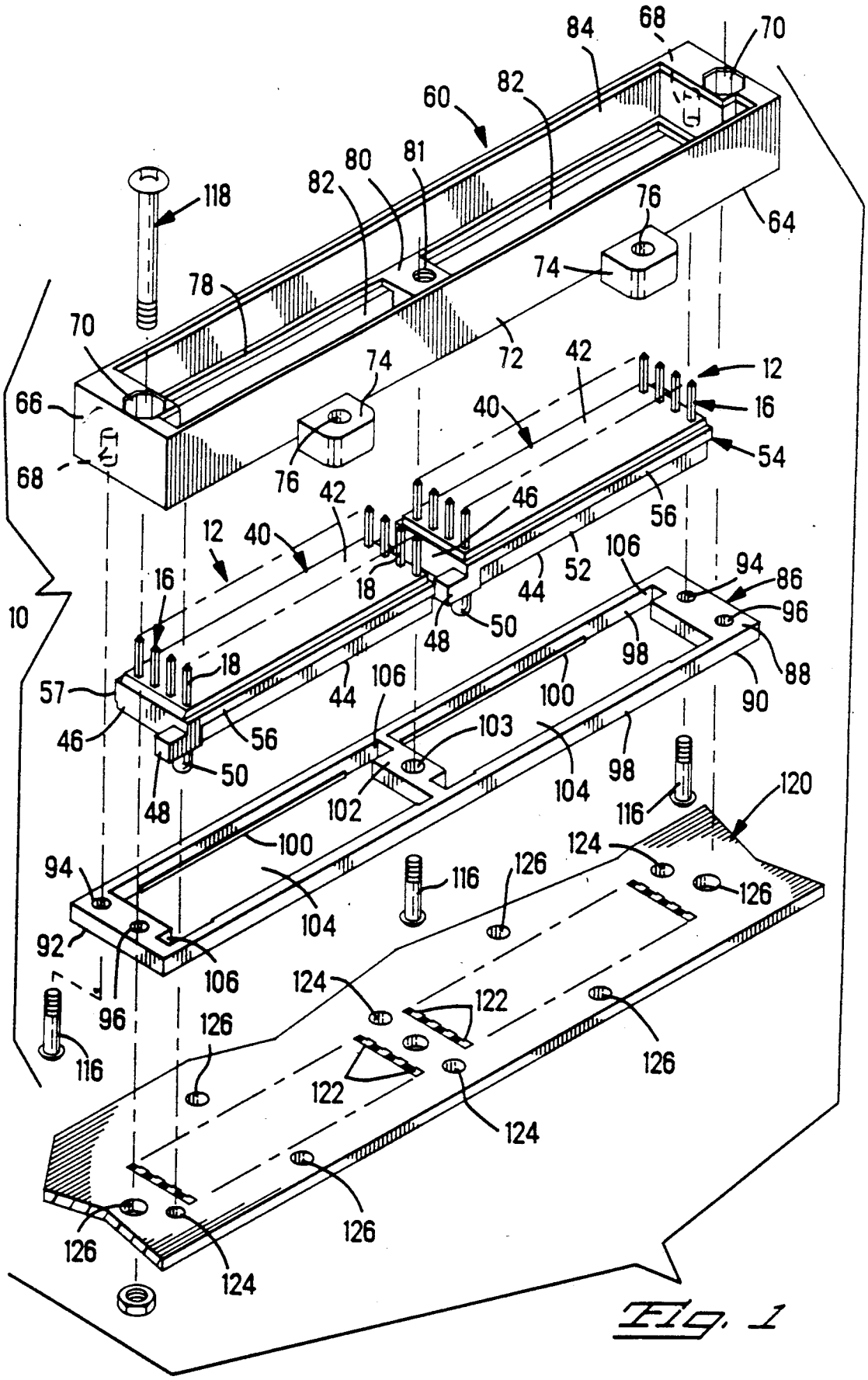
FIG. 1 is a perspective view of the connector of the present invention exploded from a circuit board and the parts of the connector exploded from each other.

The present invention is directed to an improved pin header connector 10 that is surface mountable to circuit substrate 120. Referring now to FIGS. 1 through 4, pin header connector 10 of the present invention includes a plurality of modular terminal subassemblies or inserts 12 secured in shell means 59 in a manner permitting incremental floating of the subassemblies 12 in a transverse direction relative to the shell means. In the preferred embodiment the shell means 59 includes forward and rearward shell members 60,86. Each modular subassembly 12 includes an array 14 of terminal members 16 secured in dielectric means 40 having mating and mounting surfaces 42,44 respectively. Each terminal member 16 includes a forward connecting portion 18 at least exposed at the mating surface 42 of corresponding dielectric means 40 and rearward connecting portion 20 at least exposed at the mounting surface 44 of dielectric means 40. In the preferred embodiment the second connecting portions 20 of each array 14 of terminal member 16 are adapted to electrically engage respective conductive areas 122 on a circuit substrate 120.

Figures 2, 3:
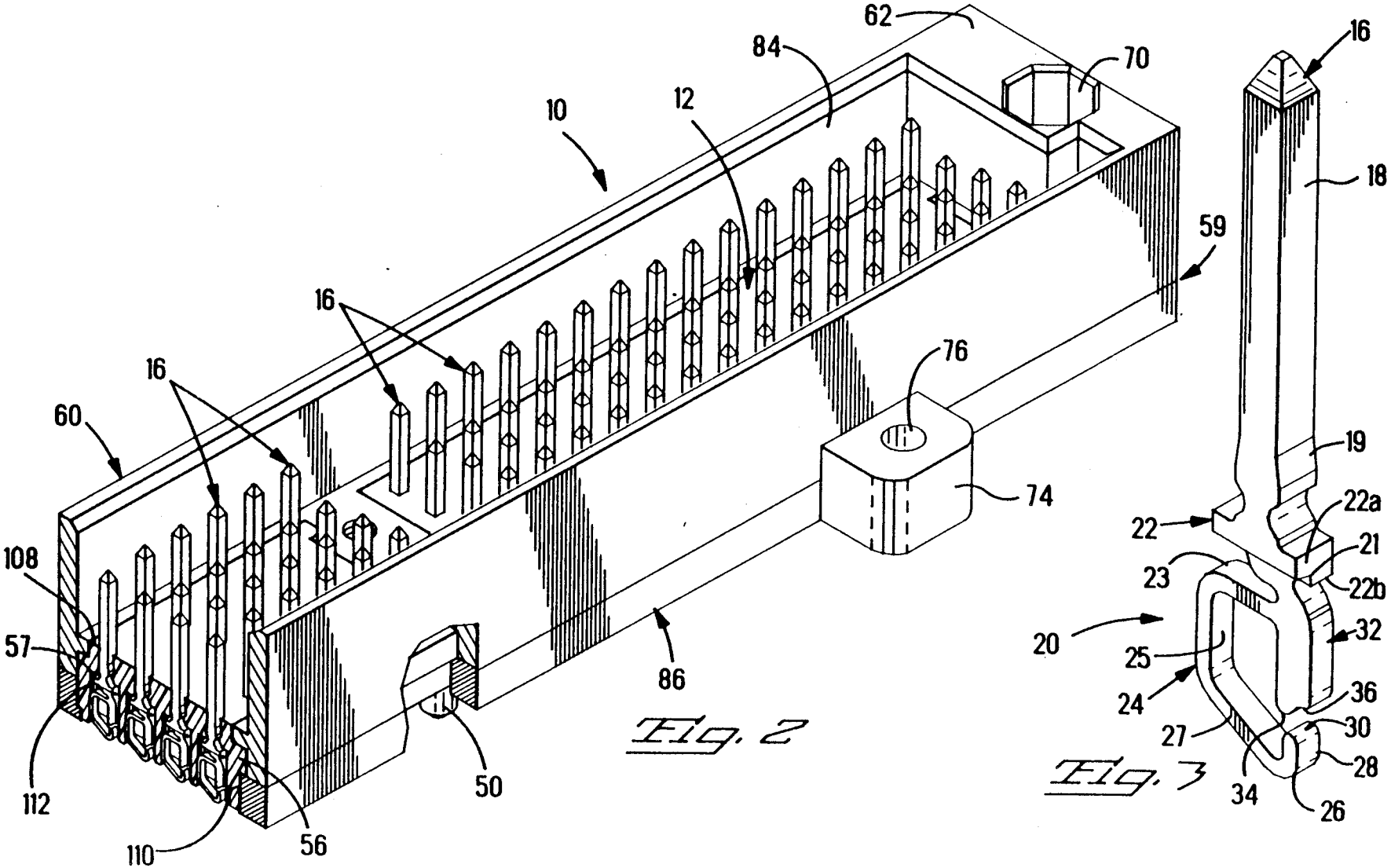
FIG. 2 is a fragmentary portion of the assembled connector of FIG. 1, with part of the connector in cross section and part of the housing broken away.
FIG. 3 is a perspective view of the terminal member.

As best seen in FIG. 3, each terminal member 16 has a forward mating end 18, intermediate retention section 19 and second connecting portion 20. The second connecting portion 20 of terminal 16 includes a generally T-shaped member 22 having first and second spring arms 24,32 extending outwardly therefrom. Spring arm section 24 is a generally C-shaped member having upper side and lower arm portions 23,25,27 respectively and a hook shaped arm 28 extending upwardly from a free end of lower arm 27 and essentially parallel to the longitudinal axis of terminal member 16.. Arm portion 27 includes contact surface 26 along its lower surface and arm section 28 includes a convex contact section 30 thereon. Second arm portion 32 extends downwardly from arm 22 essentially parallel to the longitudinal axis of terminal 16 and includes an enlarged end having a convex portion 34 and an essentially concave portion 36. Concave portion 36 provides anti-overstress protection for terminal member 16 as more fully explained below. T-shaped Member 22 includes a first portion **22*a* which is the same thickness as first connecting portion 18 and retention portion 19 and a thinner section 22*b*. The thinner material is continued into the second connecting portion 20 to provide more flexibility for the arms 24 and 32**.

Preferably terminal members 16 are stamped and formed from suitable conductive materials such as beryllium-copper or phosphor bronze. As is known in the art, the stock material is typically skived to form the two thickness of material prior to stamping and forming the terminal members. The skiving line is shown representatively as 21 in FIG. 3. First connecting portion 18 is shown representatively as a square post. It is to be understood that other configurations of the first connecting portion of terminal members 16 may also be used.

Figure 4:
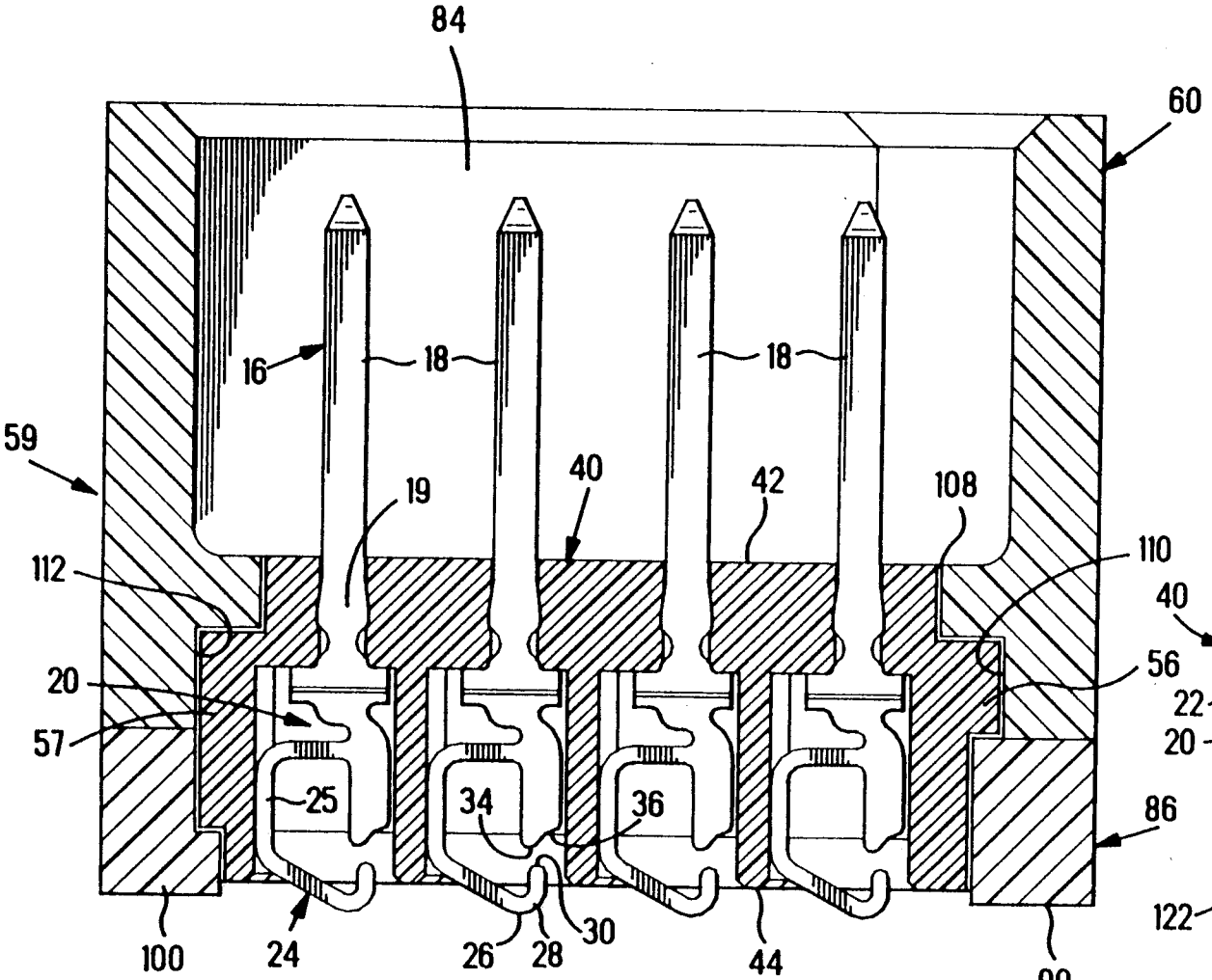
FIG. 4 is a cross sectional view of the connector of FIG. 1.

As best seen in FIGS. 1 and 4, dielectric means 40 includes opposed ends 46 and opposed parallel sides 52. Flanges 56,57 extend outwardly from and along the length of opposed parallel sides 52 of dielectric substrate 40, as best seen in FIG. 4. Extending outwardly from at least one end 46 and preferably both ends 46 are salients 48. Extending downwardly from at least one of the salients 48 and away from the mating face 44 of substrate 40 are aligning posts 50, which cooperate with apertures in the substrate as more fully explained below to align the corresponding contact sections 26 of the terminal subassembly 12 with the corresponding contact pads 122 upon mounting the connector 10 to the substrate 120. Preferably salients 48 and aligning posts 50 are located at diagonal corners of substrate 40.

Forward shell 60 includes opposed mating surface 62 and lower surface 64, opposed end walls 66, opposed parallel side walls 72 and at least one transverse wall 80 extending between side walls 72. End wall 66 includes a first aperture 68 (shown in phantom in FIG. 1) extending at least partially thereinto for receiving means 116 for securing forward and rearward shell members 60,86 together, and a second aperture 70 extending through wall 66 for receiving means 118 for mounting the connector 10 to substrate 120. In the preferred embodiment of the invention, additional mounting flanges 74 extend outwardly from opposed sides 72 of forward shell member 60. Mounting flanges 74 include apertures 76 for receiving mounting means (not shown) therethrough and securing the connector 10 to the circuit board 120. Forward shell 60 further includes inwardly projecting rails 78 extending along the longitudinal side walls 72 of shell 60. Transverse walls 80 extend between the side walls 72 at spaced intervals therealong to define a plurality of sections 82 proximate the lower surface 64, the number of sections 82 corresponding to the number of terminal subassemblies 12 in the assembled connector 10. Forward shell 60 further includes cavity 84 configured to receive a mating connector thereinto from the mating face 62 thereof.

Rearward shell 86 includes opposed upper surface 88 and mounting surface 90, opposed ends 92 and opposed longitudinal sides 98. Ends 92 include first apertures 94 for receiving shell securing means 116 in assembling shell means 59 and second apertures 96 for receiving mounting means 118 therethrough for mounting connector 10 to the substrate 120. Extending longitudinally along An inwardly directed rail 100 extends longitudinally along at least a portion of one of the side walls 98 and transverse walls 102 extend between sides 98 at spaced intervals to subdivide the lower shell into sections 104. The sections 104 are identical in length and number to sections 82 in forward shell member 60. Each section 104 preferably contains a notch 106 along opposed ends and at diagonally opposite corners thereof, the notches 106 being configured to receive corresponding salients 48 of respective terminal subassemblies 12 when connector 10 is assembled.

Shell members 60 and 86 are securable together by securing means, shown representatively as screws 116, to define a plurality of terminal receiving cavities 108 therebetween, each cavity 108 including flange retention tracks 110 and 112 extending longitudinally along opposed sides thereof. Retention tracks or slots 110 and 112 are dimensioned to receive the corresponding outwardly extending flanges 56,57 of the respective dielectric means 40 when the connector 10 is assembled together. Each of the terminal subassembly cavities 108 is dimensioned to be incrementally longer and wider than the respective subassembly 12 received therein such that the subassembly 12 can "float" or move back and forth within the tracks or slots 110,112 of the associated terminal receiving cavity 108. This floatable mounting allows each individual terminal subassembly 12 to be aligned at a precise location on the circuit substrate 120, independently of the other subassemblies and independently of the mounting means for mounting the connector to the substrate. Connector 10 is assembled by placing respective terminal subassemblies 12 between forward and rearward shell members 60, 86 such that the first connecting portions 18 of terminal members 16 extend into connector receiving cavity 84, and contact surface 26 of second connecting portions 20 extend outwardly from the mating surface 90 of rearward shell member 86, as is best seen in FIG. 4.

Figure 5:
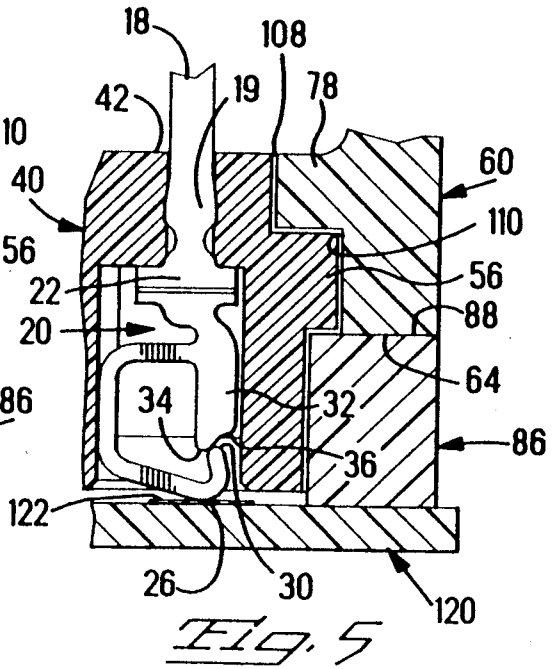
FIG. 5 is a fragmentary portion of one terminal element electrically engaged with a conductive area on a circuit board.

As is shown in FIG. 1, substrate 120 includes a plurality of arrays of circuit pads 122 on a surface thereof, one array for each terminal subassembly 12 of connector 10; a plurality of alignment apertures 124 extending through substrate 20, a pair of alignment apertures 124 disposed proximate diagonal corners of each array 122; and a plurality of mounting apertures 126 extending through substrate 120 with one at each end of the plurality of arrays 122 and others disposed at desired locations along the longitudinal sides of the arrays. As connector 10 is mounted to the substrate 120, the corresponding mounting posts 50 on respective dielectric means 40 are received in corresponding apertures 124. By engaging the two corresponding posts 50 of each terminal subassembly 12 in corresponding mounting holes 124, the contact surfaces 26 of the array of terminal members 16 in the corresponding substrate 40 is brought into alignment with the contact pads 122 as shown in FIG. 5. When the connector 10 is mounted to the substrate, corresponding contact sections 26 on the exterior of second connecting portion 20 are brought into alignment with pad 122 such that the convex end 30 of upwardly extending arm 28 is brought into electrical engagement with surface 34 of second arm 32 thus providing a short electrical path between pad 122 through arm 32 and to the first connecting portion 18. It is to be understood that terminal members such as those shown in U.S. Ser. No. 07/452,523 previously discussed may also be used in a similar manner.

In making the connector 10 of the present invention, dielectric means 40 is preferably molded around the array of terminal members 16 by a process known as insert molding. The dielectric material is preferably a glass filled polyester. The shell members 60,86 are preferably made from metal such as zinc or aluminum. Other suitable materials may also be used.

In assembling the connector 10 of the present invention, the modular subassemblies 12 are placed into the forward shell member from the bottom thereof such that the upper surfaces of flanges 56, 57 rest against the corresponding inwardly directed rails 78 of the associated section 82 to hold the subassembly 12 in forward shell member 60. The rearward shell member is then secured to the bottom surface of the forward shell member with a plurality of securing means shown representatively as screws 116, which are inserted into corresponding apertures 94,68 in end walls 92,66 and apertures 103,81 in corresponding transverse walls 102,80. As best seen in FIG. 4, the top surface 88 of rearward shell member rests against the lower surface of subassembly flange 56 and the upper surface of rail 100 rests against the lower surface of flange 57 to hold the respective terminal subassemblies 12 within shell means 59. Once the shell members 60, 86 have been secured in place the terminal subassembly have a limited movement both longitudinally and transversely to allow alignment when the connector 10 is mounted to the substrate 120. In the preferred embodiment, flanges 56 and 57 are of different thicknesses to provide means for orienting the modular subassemblies within the respective subassembly receiving cavities 108. As can best be seen from FIG. 1 mounting means 118, shown as a bolt and nut is used to secure the assembled connector 10 to the circuit substrate 120 by inserting the bolt through the aligned apertures 70,96 and 126 and by using a similar means through apertures 74 and corresponding apertures 126. The mounting means are spaced from the modular subassemblies thereby allowing the subassemblies to be free to move without interference from the mounting means.

Referring now to FIG. 5, an enlarged portion of one of the terminal members 116 is shown in electrical engagement with a corresponding pad 122 after connector 10 has been mounted to substrate 120. The compression of the spring arm 24 provides an effective normal force against the pad 122 for desired electrical continuity and the interconnection between contact surfaces 30 and 34 provide a short electrical path for transmitting electrical current between the substrate and the corresponding terminal member. Concave surface 136 acts as an anti-overstress device to prevent the contact arm 24 from being compressed too far such that electrical continuity is not maintained.

Figure 6:
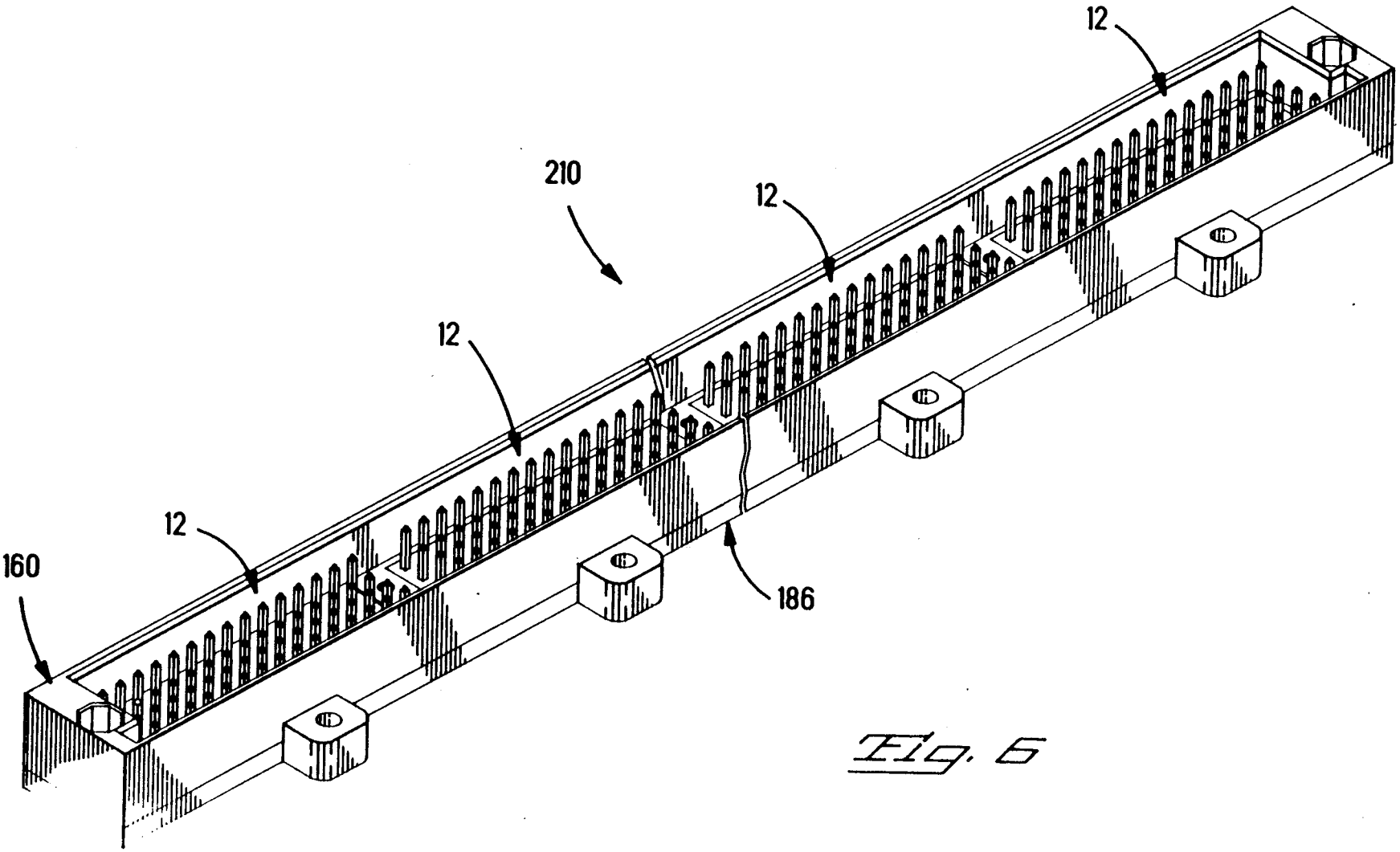
FIG. 6 is a perspective view of an alternative embodiment of the present invention.

FIG. 6 illustrates another embodiment 210 of the invention in which a plurality of modular terminal subassemblies 12 are disposed in forward and rearward shell members 160,186.

While it is preferable to insert mold dielectric means 40 around the terminal members 18, it is to be also understood that the dielectric means may be formed such that individual terminal receiving passageways are formed therein and the terminal members can be loaded into the preformed dielectric member. By using a plurality of independently moving modular subassemblies, a build-up of tolerances is prevented particularly in those instances where there are a large number of subassemblies held within a long shell means. For example, pin header connectors have been made up to eighteen inches long with the number of terminal members exceeding 700. As the number of subassemblies and arrays of terminals therein is increased, the chances for tolerance build-up and non-alignment of all of a terminal member increases.

The connector of the present invention provides a means whereby arrays of terminal members, each of a reasonable size, can be aligned with corresponding arrays of contact pads on a circuit substrate. Furthermore, by using a pin header connector having a plurality of modular subassemblies, the same shell members can be used with a plurality of different arrangements of terminal members by merely changing the arrangements of the terminals with a molded insert member. This allows greater flexibility in designing card connectors and allows for easy repair by replacement of a single insert should a problem occur.

It is thought that the connector of the invention and many of its attendant advantages will be understood from the foregoing description. Changes may be made in the form, construction and arrangement of parts thereof without departing from the spirit and scope of the invention or sacrificing all of its material advantages.

We claim:

1. An improved pin header connector mountable to a circuit substrate comprising:

a plurality of terminal subassemblies, each subassembly comprising an array of terminal members secured in dielectric means, each said dielectric means having mating and mounting surfaces, each said terminal member having a forward connecting portion at least exposed at said mating surface and a rearward connecting portion at least exposed at said mounting surface, said second connecting portions of said array of terminal members being adapted to electrically engage respective conductive areas of a corresponding array on the circuit substrate;

shell means defining a like plurality of terminal subassembly receiving cavities and including means securing said terminal subassemblies within respective said cavities in a manner permitting incremental floating of said subassemblies in a transverse direction relative to said shell means, defining a connector;

means included on each said terminal subassembly for aligning thereof cooperable with corresponding aligning means of the circuit substrate associated with each said array of conductive areas by causing incremental transverse movement of each said terminal subassembly within a respective said cavity, such that said second connecting portions of each said array of terminal members are aligned with respective conductive portions of a respective corresponding array on said substrate upon connector mounting thereon; and means independent of said aligning means for mounting said shell means to said substrate such that said terminal members are electrically engaged with corresponding conductive pad arrays on said substrate, whereby the connector so defined includes terminal subassemblies each independently alignable with corresponding arrays of conductive areas on said substrate while being retained in a common shell.

2. The connector of claim 1 wherein said means for securing each said terminal subassembly within said subassembly cavity includes flanges extending outwardly along opposed longitudinal sides of each said dielectric means, said flanges being received in complimentary flange receiving tracks defined along corresponding inner walls of said shell means.

3. The connector of claim 2 wherein said opposed flanges are of different thicknesses, thereby providing keying means for said subassembly in said cavity.

4. The connector of claim 1 wherein said aligning means includes at least one aligning post extending downwardly from the mating surface of said dielectric means of each said terminal subassembly, said at least one aligning post being received in a corresponding aligning aperture associated with said corresponding array of conductive areas on said circuit board.

5. The connector of claim 1 wherein said shell means includes forward and rearward members.

6. The connector of claim 5 wherein said aligning means includes at least one aligning post extending downwardly from the mating surface of said dielectric means of each said terminal subassembly, said at least one aligning post being received in a corresponding aligning aperture associated with said corresponding array of conductive areas on said circuit board.

7. The connector of claim 5 wherein said means for securing each said terminal subassembly within said subassembly cavity includes flanges extending outwardly along opposed longitudinal sides of each said dielectric means, said flange being received in complimentary flange receiving tracks defined along corresponding inner walls of said forward and rearward shell members, said track being formed upon said forward and rearward shell members being secured together.

8. The connector of claim 7 wherein said opposed flanges are of different thicknesses, thereby providing keying means for said subassembly in said cavity.

* * * * *

UNITED STATES PATENT OFFICE

CERTIFICATE OF CORRECTION

Patent No. 4,998,887 Dated March 12, 1991

Inventor(s) John W. Kaufman and Donald J. Summers

It is certified that error appears in the above-identified patent and that said Letters Patent are hereby corrected is shown below:

In the Claims:

Claim 7, Column 8, Line 34 - the word "flange" should be --flanges--.

Signed and Sealed this

Fifteenth Day of September, 1992

*Attest:*

DOUGLAS B. COMER

*Attesting Officer*

*Acting Commissioner of Patents and Trademarks*